United States Patent [19]

Nishikawa

[11] 4,394,432

[45] Jul. 19, 1983

[54] METHOD FOR PRINTING A PLURALITY OF DUPLICATED COPIES FROM THE SAME ELECTROSTATIC CHARGE LATENT IMAGE

[75] Inventor: Masaji Nishikawa, Hachioji, Japan

[73] Assignee: Olympus Optical Company Limited, Tokyo, Japan

[21] Appl. No.: 268,329

[22] Filed: May 29, 1981

Related U.S. Application Data

[63] Continuation of Ser. No. 9,585, Feb. 5, 1979, abandoned.

[30] Foreign Application Priority Data

Feb. 8, 1978 [JP] Japan ..... 53-13995

[51] Int. Cl.[3] ..... G03G 13/16

[52] U.S. Cl. ..... 430/120; 430/122; 430/126

[58] Field of Search ..... 430/120, 122, 126

[56] References Cited

U.S. PATENT DOCUMENTS

| | | | |
|---|---|---|---|
| 2,904,000 | 9/1959 | Fisher et al. | 430/122 |
| 3,961,951 | 6/1976 | Mayer et al. | 430/126 |
| 4,242,434 | 12/1980 | Hirakura et al. | 430/126 |
| 4,265,997 | 5/1981 | Extra et al. | 430/120 |

*Primary Examiner*—John E. Kittle
*Assistant Examiner*—John L. Goodrow
*Attorney, Agent, or Firm*—Fleit, Jacobson & Cohn

[57] ABSTRACT

In a method for printing in an electrophotographic manner a number of duplicated copies by repeatedly effecting developing and transferring steps for the same and single electrostatic charge latent image once formed on a charge retentive member such as a photoconductive drum, in order to compensate a variation in print density of a number of copies an amount of toner particles to be supplied to the latent image during the developing step is adjusted in such a manner that the copies have substantially the same print density. The adjustment of an amount of toner particles can be effected by changing a supply speed of the toner particles, a thickness of a magnetic brush, a distance from the magnetic brush to the latent image, etc.

5 Claims, 9 Drawing Figures

METHOD FOR PRINTING A PLURALITY OF DUPLICATED COPIES FROM THE SAME ELECTROSTATIC CHARGE LATENT IMAGE

This is a continuation of application Ser. No. 009,585, filed Feb. 5, 1979 now abandoned.

BACKGROUND OF THE INVENTION (1) Field of the Invention

The present invention relates generally to an electrophotography, and more particularly to a method for printing a plurality of duplicated copies with the aid of the same and single electrostatic charge latent image once formed on an electrostatic charge retentive member such as a photoconductive or dielectric drum. Such a multiple duplication method generally comprises a step for forming an electrostatic charge latent image corresponding to an image of a document to be duplicated on a charge retentive member; a step for developing the latent image with toner particles to form a visible toner image on the charge retentive member; a step for transferring the developed toner image onto an image receiving member such as a sheet of paper; a step for fixing the transferred toner image on the image receiving member, and a step for repeating successively the developing, transferring and fixing steps for successively supplied image receiving members, while maintaining the latent image once formed on the charge retentive member.

(2) Description of the Prior Art

Various methods have been proposed for printing a plurality of duplicated copies in electrophotography. For instance, U.S. Pat. No. 2,951,443 describes such a method. However, it has been found that this method produces copies having smaller picture or print density in accordance with the number of copies. U.S. Pat. No. 3,363,555 discloses a multiple duplication method in which a transferring bias voltage applied to a transferring roller is changed in accordance with the number of copies to maintain a constant print density. When the transferring bias voltage is high, an imagewise bright background of the charge latent image might be electrified and thus so-called fog or overdevelopment might occur. This fog is easily produced under a high humidity. Japanese patent application laid-open Publication No. 89,421/76 (corresponding to U.S. patent application Ser. No. 536,712) also discloses a multiple duplication method wherein a developing bias voltage applied to a developing electrode is adjusted in accordance with the number of copies in order to make print density constant. This method does not provide copies having excellent image quality, because the density of higher print density part is developed to an insufficient extent, when the developing bias voltage is so adjusted that copies having constant print density at lower density part can be obtained, while the density of lower print density part is liable to be overdeveloped, when the developing bias voltage is adjusted to provide copies having constant print density at higher density part. Moreover this method also produces said fog in the imagewise bright background.

SUMMARY OF THE INVENTION

The present invention has for its object to provide an improved electrophotographic method for printing a plurality of duplicated copies with the aid of the same and single electrostatic charge latent image once formed on an electrostatic charge retentive member, in which substantially all the duplicated copies have constant print density both at high and lower density portions of the duplicated image and do not show any fog or overdevelopment in an imagewise bright background.

According to the present invention a method for printing a plurality of duplicated copies with the aid of the same and single electrostatic charge latent image once formed on an electrostatic charge retentive member comprises a step for forming on the charge retentive member the electrostatic charge latent image corresponding to an image of a document to be duplicated; a step for developing the latent image with toner particles to form a visible toner image on the charge retentive member; a step for transferring the toner image onto an image receiving member, and a step for fixing the transferred toner image on the image receiving member, and a step for repeating successively the developing, transferring and fixing steps for successively supplied image receiving members, while retaining the latent image, whereby an amount of toner particles to be supplied to the latent image during the developing step is adjusted in such a manner that the print density of the duplicated copies may not vary in accordance with the number of copies.

In a preferred embodiment of the invention the development is effected by a relative movement of the toner particles and the latent image, whereby an amount of toner particles to be supplied to the latent image is adjusted by changing the speed of the movement. For instance, if the charge retentive member is moved with respect to a fixed developing device, an amount of toner particles which serve to develop the latent image may be changed by adjusting the moving speed of the charge retentive member.

In another embodiment of the invention the development is effected with the aid of a magnetic brush developing device comprising a magnet device, a sleeve rotatably arranged around the magnet device and a doctor blade for defining a thickness of hairs of a magnetic brush formed by a two component developer including toner particles and magnetic carriers, whereby an amount of toner particles to be supplied to the latent image is adjusted by changing a gap width between the doctor blade and the sleeve.

In another embodiment of the invention the charge retentive member is formed as a drum which rotates at a constant speed with respect to a fixedly arranged developing device, whereby an amount of toner particles to be applied to the latent image is adjusted by changing a distance between the developing device and the charge retentive drum.

In still another embodiment of the method according to the invention the development is carried out by means of a magnetic brush developing device comprising a magnet roller and a sleeve rotatably arranged around the magnet roller, whereby an amount of toner particles applied to the latent image is adjusted by moving the magnetic roller with respect to the charge retentive member so as to displace a position of magnetic poles of the magnet roller.

DESCRIPTION OF THE PREFERRED EMBODIMENTS

Figure 1:
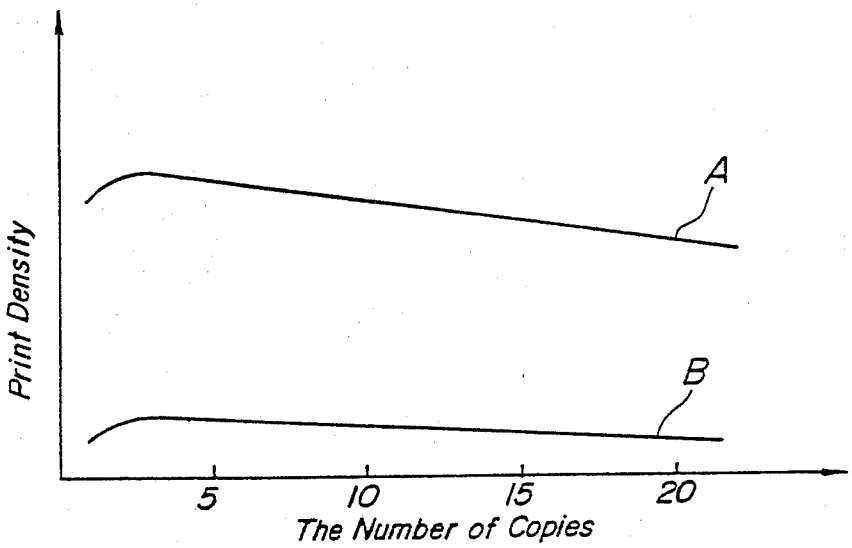
FIG. 1 is a graph showing a relationship between the number of duplicated copies and print density in multiple duplication process.

When an electrostatic charge latent image formed on a photoconductive or dielectric member is repeatedly developed with a developer and each developed image is transferred onto respective recording medium, it is inevitable that said electrostatic image degrades by discharge through said photoconductive or dielectric member, discharge through developer during said developing step and discharge during said transferring step. Moreover some developing or toning devices do not develop the latent image up to a saturated development. In such unsaturated development residual toner particles on the latent image promote next development and thus print density increases successively until a saturated development is achieved. This increase in picture density is often observed especially for a first few copies. FIG. 1 shows relationships between print density and the number of duplicated copies. The measurement was carried out for a selenium photoconductor, on which an electrostatic image is formed by an exposure after a uniform electrification of approximately 450 volts. The electrostatic image thus formed is then developed with a two-component dry developer including iron powder carrier particles the surfaces of which are oxidized and toner particles by 7% by weight while applying a developing bias voltage of approximately 100 volts. Next the toner image is transferred onto a recording medium. Said developing and transferring steps are repeated for one and the same electrostatic latent image to form a plurality of duplicated copies. A curve A represents a variation in print density at a high density part of the printed images, while a curve B represents that at a lower density part of the printed images. During the transferring step a transferring bias voltage of approximately 600 volts is applied to a transferring roller. Approximately 40 percent of whole the toner particles on the toner image was not tranferred onto the recording medium and remained on the toner image. FIG. 1 shows a successive increasement of print density for a first few copies due to the above mentioned unsaturated development and a successive decreasement of print density thereafter. The decreasement of print density is assumed to be caused by a dark decay of the selenium photoconductor. The printed image of No. 20 shows a fall of print density at the higher density part and difficulty of recording fine lines at the lower density part.

In order to compensate such a variation in print density it has been proposed to adjust the developing and/or transferring bias voltages. On the contrary the present invention provides a method for controlling the developing step; precisely speaking, a method for mechanically adjusting an amount of developer to be supplied to the latent image during the developing step.

For example, an amount of developer, i.e. toner particles may be changed by changing a supplying speed of developer, i.e. the speed of supply of developer to the electrostatic charge latent image. A more rapid supply of developer can promote a development. Thus the latent image which might provide a picture of low print density under a low supply speed can be developed with high print density under a higher supply speed of developer. Therefore according to FIG. 1 a plurality of duplicated copies having constant print density can be obtained by making the supplying speed of developer successively slower for a first few copies and thereafter by making said speed successively faster.

In case of a magnetic brush developing device the developer is attached on a surface of developing roller which magnetically attracts the developer, the developing roller is rotated near the electrostatic charge latent image during which the developer is applied to an electrostatic charge latent image. Therefore the supply speed of developer can be controlled by adjusting the revolution speed of the developing roller. A magnet roller may be used as the developing roller. Alternatively a sleeve may be concentrically provided around the magnet roller to form an applicator roller the applicator roller being rotated as the developing roller. The revolution speed of the developing roller is not necessarily proportional to the degree of development; for example, under a condition of near the saturated development print density cannot be varied so much in comparison with the change of revolution speed. The revolution speed may be continuously changed, but in some cases the revolution speed may be changed in a stepwise manner. The revolution speed can be continuously changed by electrically controlling a DC motor or generally a stepless variable speed motor as a rotation drive means. Alternatively the revolution speed may be continuously changed by a mechanical stepless variation in speed of a rotation drive means, for example with the aid of a tapered rim. On the other hand the revolution speed may be stepwisely changed, for example by switching a connection of a double-speed motor or a change gear ratio of a drive gear.

Figure 2:
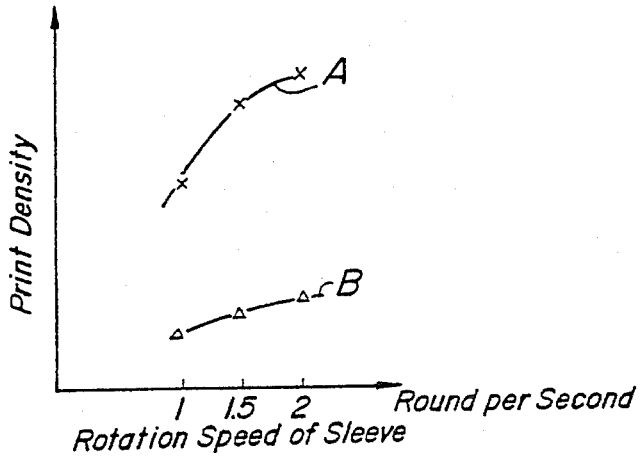
FIG. 2 is a graph illustrating a relationship between rotating speed of a sleeve of a magnetic brush developing device and print density.

FIG. 2 shows a variation of print density when the revolution speed of the sleeve of the magnetic brush developing device is switched to 1, 1.5 and 2 revolutions per second under the condition that the best copy is obtained when said sleeve is rotated at a revolution speed of 2 revolutions per second. This measurement was conducted under following conditions. An electrostatic charge latent image was formed on a drum of 130 mm in diameter with a photoconductive layer of selenium, the drum being rotated with a speed of 10 r.p.m. A sleeve of 24 mm in diameter was concentrically provided around a magnet roller. The height of hairs of a magnetic brush formed by a two-component dry developer attached on the sleeve was adjusted to 4 mm in height (this adjustment may be realized with a doctor blade, as hereinafter described). The development was carried out by making the developer haris in contact with the photoconductive drum while rotating the sleeve. A curve A represents a variation in print density at a higher density part, while a curve B represents that at a lower density part as in FIG. 1. The print density is more largely varied with the switching of the revolution speed of the sleeve at higher density part than at lower density part. Since the electrostatic charge latent image is degraded substantially correspondingly to the latent image potential, that is a higher density part is more repidly degraded than a lower density part as is shown in FIG. 1, the above described characteristic of revolution speed-print density is very suitable for compensating a degradation of the electrostatic latent image.

Figure 3:
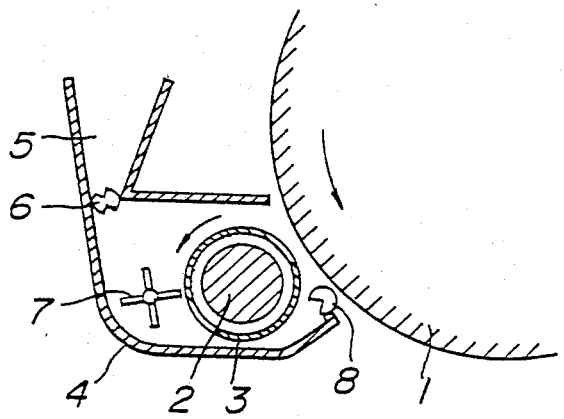
FIG. 3 is a cross section depicting schematically an embodiment of a magnetic brush developing device which can control print density by changing a thickness of a brush formed by a developer attached on a sleeve.
Figure 4A:
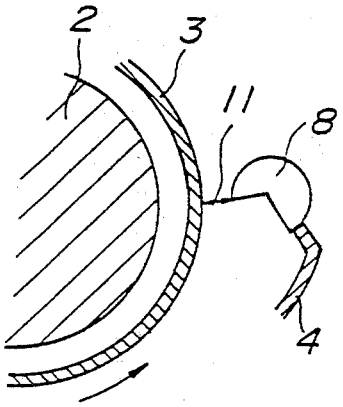
FIGS. 4(A) and 4(B) are enlarged cross sections illustrating a part of the device shown in FIG. 3.
Figure 4B:
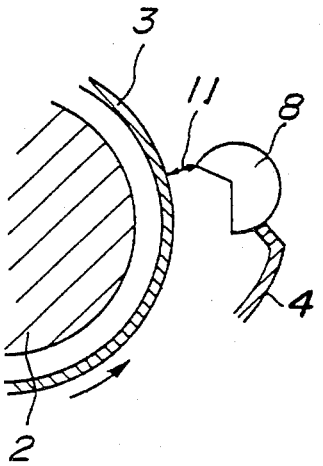

FIG. 3 shows an embodiment of the developing device for use in the method according to the invention in which an amount of developer to be supplied is adjusted by changing the height of developer hairs formed on a developing roller, i.e., the thickness of developer instead of changing the supply speed of developer. In this case a developing roller is also used to develop a latent image formed on a drum 1 having a photoconductive layer and the developing roller also comprises a magnet roller 2 and a rotating sleeve 3 provided concentrically thereon. The developing roller (2, 3) is arranged in a housing 4, the upper part of which constitutes a reservoir 5 for toner. A proper amount of toner in the reservoir 5 is fed into the housing 4 with a rotation of knurled roller 6, where the fed toner is uniformly mixed with magnetic carriers by a blade-type agitator 7. Thus prepared two-component dry developer attracted onto an outer surface of the sleeve 3 like hairs to form a so-called magnetic brush. The hairs rotate with the rotation of the sleeve 3 and pass near a doctor blade 8. At this moment the top of the hairs are cut away with the doctor blade 8 to provide a uniform height of hair. Such a doctor blade is also provided in the first embodiment in which the revolution speed of the sleeve 3 is adjusted. In the second embodiment the height of hairs is changed by adjusting a distance between the sleeve 3 and the doctor blade 8, namely, a doctor blade gap 11. As is shown in FIGS. 4(A) and 4(B), not only the doctor blade gap 11 but also an angle formed with a doctor surface 12 and a plane normal to the sleeve 3 are changed by rotating the doctor blade 8. In a position shown in FIG. 4(A), said angle is small and the doctor blade gap 11 is narrow so that the height of the developer hairs will become short. In a position shown in FIG. 4(B), said angle is large and the doctor blade gap 11 is wide so that the height of the developer hairs will become long. Since in this embodiment the change of the angle formed with a doctor surface 12 and a plane normal to the sleeve 3 cooperates with the change of the doctor blade gap 11, the height of developer hairs can be adjusted within a large range with a slight rotation of the doctor blade 8. The longer the developer hair is, the higher the toner density of the developed image becomes.

Figure 5:
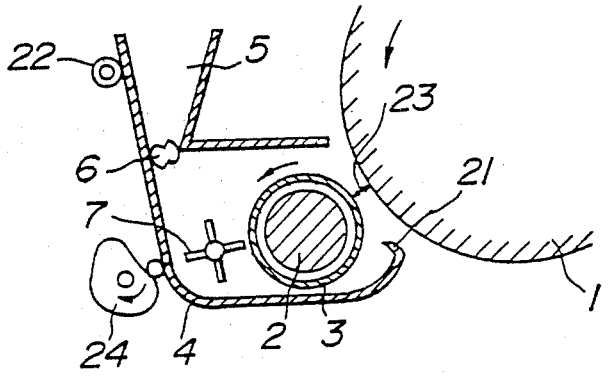
FIG. 5 is cross section showing another embodiment of developing device for use in the method according to the invention which can control print density by changing a developing gap.

FIG. 5 shows a modification of the second embodiment shown in FIG. 4. In this modified embodiment, the distance between a doctor blade 21 and a developing roller (2, 3) is kept constant and instead whole the system comprising the developing roller (2, 3) and housing 4 is rotated around a rotation axis 22. The construction of for example the developing roller (2, 3) are the same as those shown in FIG. 4. By the above rotation of the system the height of developer hairs is kept constant, but the distance between the developing roller (2, 3) and the drum 1 having a photoconductive layer, namely, a developing gap 23 can be adjusted. It has been found experimentally that print density increases by making the developing gap 23 narrower and that the quality of character pictures are good although an edge of a large picture becomes somewhat faint or disappear when the developing gap exceeds beyound a certain limit. On the contrary print density decreases by making the developing gap 23 broader, but any other disadvantage does not occur. The print density can be adjusted widely by changing the developing gap 23 and the adjustment range is sufficiently wide enough to make the print image constant over a number of copies.

In FIG. 5 a cam disc 24 is rotated in accordance with the number of duplicated copies by a ratchet machanism (not shown) and whole the system of developing means is rotated around the axis 22 in accordance with said rotation of the cam disc 24 to adjust the developing gap 23. In the case where picture density varies as shown in FIG. 1 without correction, the profile of the cam disc 24 is selected so as to successively broaden the developing gap 23 for a first few copies and to successively narrow the gap 23 thereafter. The mechanism for adjusting the developing gap 23 is not limited to the above mechanism; for example, in the case where a developing gap is selected between only two widths, another simpler mechanism than a cam mechanism such as a solenoid mechanism can be employed.

Figure 6:
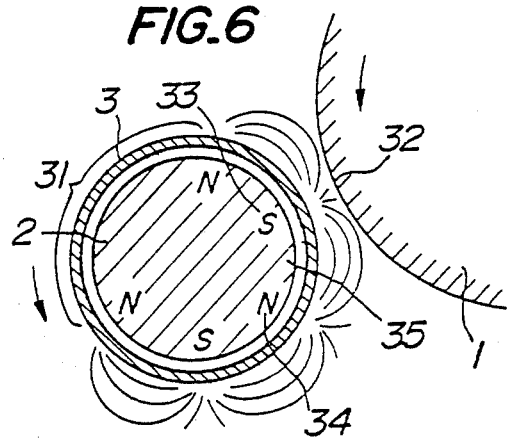
FIG. 6 is a cross section illustrating still another embodiment of the developing device in which print density can be adjusted by changing angular position of poles of a magnet roller.

FIG. 6 is a cross section for illlustrating another embodiment of the invention. A magnet roller 2 is usually fixed in the case where a developing roller consists of a magnet roller 2 and a sleeve 3 and the sleeve 3 is rotated. In this embodiment the magnet roller 2 is rotated in order to adjust the degree of development.

When the fixed magnet roller 2 is magnetized as shown in FIG. 6, lines of magnetic force are aligned as shown in the figure and magnetic developer particles are arranged on said lines of magnetic force. A sleeve 3 of non-magnetic material such as aluminum is concentrically provided around the magnet roller 2 and is rotated in the direction indicated by an arrow. When the sleeve 3 rotates, the magnetic developer particles are moved along said lines of magnetic force at a speed substantially equal to that of the sleeve 3. The magnetic developer particles drop off the sleeve 3 at a region 31 where no magnetic pole exists and they are mixed and agitated. Then the particles are picked up and held by magnetic force and carried with the rotation of the sleeve 3. The carried developer particles serve to develop the latent image at a developing region 32 where the particles contact with the drum 1 carrying the latent image. The development is best suitably achieved when a magnetic pole is provided opposite to said developing region 32 as shown in FIG. 6, because near a magnetic pole magnetic lines of force extends perpendicular to the sleeve 3 and hairs of developer reach the developing region 32 perpendicularly, so that the brushing effect of the magnetic brush is strong. On the contrary when an intermediate part 35 between a south pole 33 and a north pole 34 is made opposite to the developing part 32, the hairs of developer extend parallel to the surface of the sleeve 3 and only surface part of developer contributes to development, so that development is weak. Therefore an amount of developer supplied to the drum 1 carrying the latent image is adjusted by rotating the magnet roller 2 so that any position from the magnetic pole 33 to the intermediate part 35 comes selectively opposite to the developing part 32.

Figure 7A:
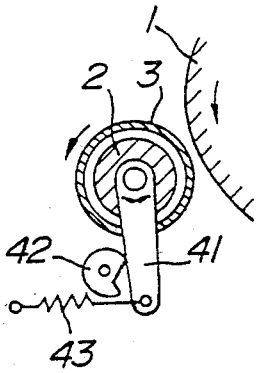
FIGS. 7(A) and 7(B) are cross sections showing two embodiments of a device for changing the angular position of the magnet roller.
Figure 7B:
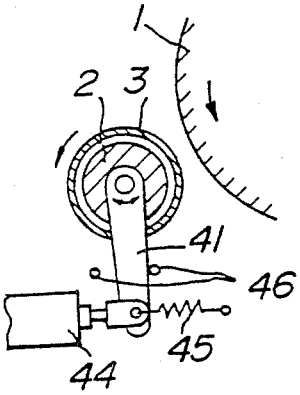

FIGS. 7(A) and 7(B) show two mechanisms for rotating the magnet roller 2. The magnetic roller 2 is attached to a lever 41. In FIG. 7(A) the lever 41 is moved by a cam disc 42 and a spring 43 in accordance with the number of duplicated copy, while in FIG. 7(B) the lever 41 is moved by a solenoid 44 and a spring 45 where the reference number 46 indicates stoppers. Therefore in FIG. 7(A) the magnet roller 2 is moved continuously, while in FIG. 7(B) the magnet roller 2 takes a position of two positions selectively. The embodiment shown in FIG. 7(B) can be applied to the apparatus in which picture density is varied only to a small extent so that a two-stage correction of picture density is practically accepted. The embodiment shown in FIGS. 6 and 7 have advantages of simple mechanism and accurate and precise correction of print density, because said correction is carried out by the rotation of the magnet roller 2. Other mechanisms for rotating the magnet roller may be used.

According to the invention an amount of developer can be effectively adjusted not only in accordance with the number of duplicated copies, but also in accordance with a potential of the electrostatic charge latent image or print density of a copy formerly duplicated. Moreover in the above embodiments use is made of the two-component dry developer, but the present invention may be applied to the developing device using an one-component dry developer. Furthermore the various methods for adjusting an amount of developer may be combined for use. The present invention may be applied to correct the variations in print density due to factors other than the repeated use of the latent image such as aging of photoconductor or light source, difference between the first copy and other copies according to an electrophotographic method by which both formation of a latent image and developing and transferring steps are employed for the first copy but only developing and transferring steps are employed for other copies thereafter, and a variation of the transferring speed.

The various methods of adjusting print density by changing the supplying speed of developer, the height of hairs of developer or the thickness of a layer of developer, the width of developing gap and the position of the magnet roller according to the present invention can offer effective control of print density and can prevent variation in print density according to the number of copies, so that a plurality of copies having constant print density can be stably printed.

Those skilled in the art may vary or modify the invention without departing from the spirit of the invention. Such variations and modifications should be understood to fall within the scope of the appended claims.

What is claimed is:

1. An improved method of printing a plurality of duplicated copies with the aid of a single electrostatic charge latent image formed on an electrostatic charge retentive member to form an electrostatic charge latent image corresponding to an image of a document to be duplicated on a charge retentive member and developing the latent image with a developer to form a visible toned image on the charge retentive member; transferring the toned image onto an image receiving member; fixing the transferred toned image on the image receiving member; and successively repeating the developing, transferring and fixing steps for the same and single latent image so as to form a plurality of duplicated copies, the improvement comprising the step of: gradually increasing the total amount of the developer supplied to the latent image on the charge retentive member while maintaining the toner concentration substantially constant for developing the latent image in such a manner, that both a large variation in print density at a higher density part in the image and a small variation in print density at a lower density part for successive copies are simultaneously corrected.

2. The method according to claim 1, wherein the developer is a dry developer including toner particles and the amount of developer including toner particles applicable to the latent image is adjusted by changing the moving speed of the developer relative to the charge retentive member.

3. The method according to claim 1, wherein the charge retentive member is formed as a drum which rotates at a constant speed at a given position and further including the step of adjusting the amount of toner particles applicable to the latent image by moving the developing device with respect to the charge retentive drum to change the distance therebetween.

4. The method according to claim 2, wherein developing of the latent image is accomplished with the aid of a magnetic brush developing device comprising a magnet device, a sleeve rotatably arranged around the magnet device and a doctor blade for defining a thickness of hairs of toner particles of a magnetic brush attracted on the outer surface of the sleeve, and including the step of adjustably supplying an amount of toner particles to the latent image by changing the gap between the doctor blade and the sleeve.

5. The method according to claim 1, wherein the developing of the latent image is carryed out by means of a magnetic brush developing device including a magnetic roller and a sleeve rotatably arranged around the magnetic roller and further including the steps of adjusting the amount of toner particles to be supplied to the latent image by moving the magnetic roller with respect to the charge retentive member so as to displace a portion of magnetic poles of the magnetic roller facing the charge retentive member.

* * * * *